US005808305A

United States Patent [19]

Leidecker et al.

[11] Patent Number: 5,808,305

[45] Date of Patent: Sep. 15, 1998

[54] METHOD AND APPARATUS FOR SORTING FRUIT IN THE PRODUCTION OF PRUNES

[75] Inventors: Cliff Leidecker, Rogue River; Park Squyres, Medford; Duncan Campbell, Central Point, all of Oreg.

[73] Assignee: SRC Vision, Inc., Medford, Oreg.

[21] Appl. No.: 735,730

[22] Filed: Oct. 23, 1996

[51] Int. Cl.[6] ..... B07C 5/342

[52] U.S. Cl. ..... 250/341.8; 209/577

[58] Field of Search ..... 250/341.8, 225, 250/226, 910; 209/577; 426/231

[56] References Cited

U.S. PATENT DOCUMENTS

| | | | |
|---|---|---|---|
| 3,675,769 | 7/1972 | Story | 209/73 |
| 3,773,172 | 11/1973 | McClure et al. | 209/73 |
| 4,146,135 | 3/1979 | Sarkar et al. | 209/580 |
| 4,262,806 | 4/1981 | Drabs | 209/577 |
| 4,279,346 | 7/1981 | McClure et al. | 209/582 |
| 4,634,881 | 1/1987 | Billion | 250/572 |
| 4,723,659 | 2/1988 | Billion | 209/576 |
| 5,085,325 | 2/1992 | Jones et al. | 209/580 |
| 5,134,291 | 7/1992 | Ruhl, Jr. et al. | 250/341 |
| 5,141,110 | 8/1992 | Trischan et al. | 209/524 |
| 5,237,407 | 8/1993 | Crezee et al. | 358/107 |
| 5,440,127 | 8/1995 | Squyres | 250/341.8 |
| 5,464,981 | 11/1995 | Squyres et al. | 250/341.8 |

FOREIGN PATENT DOCUMENTS

| | | | |
|---|---|---|---|
| 0247016 | 5/1987 | European Pat. Off. | B07C 5/342 |
| 2430272 | 2/1980 | France | B07C 5/342 |
| 1301147 | 12/1989 | Japan | G01N 21/35 |

OTHER PUBLICATIONS

NC State University, *UV/VIA/NIR Measurement Fundamentals,* Appendix 1, "Theory of Near Infrared Reflectance Spectroscopy," 1992.

The Infrared Information Analysis Center, Environmental Research Institute of Michigan, *The Infrared Handbook, Revised Edition,* pp. 3–13, 3–121, 3–129, 3–130, 1985.

*Primary Examiner*—Michael J. Tokar
*Assistant Examiner*—Richard Hanig
*Attorney, Agent, or Firm*—Stoel Rives LLP

[57] ABSTRACT

Fruit defects of interest in the production of prunes are identified based on characteristics of illumination reflected by the fruit. Various reflection characteristics can be used in this regard including near infrared reflectivity and polarization state of the reflected illumination. In one embodiment, the apparatus (10) of the present invention includes a transport system (12) for transporting fruit (14) through an inspection zone (16), an illumination system (18) for illuminating the fruit (14), a detector system (20) for detecting reflected illumination (21), a sorting system (22) for separating defective fruit from good fruit, and a control system (24) for controlling operation of the sorting system (22) based on signals from the detector system (20) and transport system (12). The signals from the detector system can be improved by treating the fruit inorder to diminish the chlorophyll response.

20 Claims, 12 Drawing Sheets

RED PRUNE AND SCAB
BLANCHED AT 210 DEGREES FOR 2 MINUTES

METHOD AND APPARATUS FOR SORTING FRUIT IN THE PRODUCTION OF PRUNES

FIELD OF THE INVENTION

The present invention relates generally to the processing of fruit in the production of prunes and, in particular, to a method and an apparatus for detecting fruit defects so that defective fruit can be eliminated from a product stream.

BACKGROUND OF THE INVENTION

In the commercial production of prunes, there are a number of fruit defects that can render the fruit (plum or prune) unacceptable. These include bug bites as well as scabs, cracks, sunburns and rot. Scabs are formed when the fruit rubs against a branch or other object while on the tree. Cracks may result when a moist growing period is followed by an intense dry period. Sunburn can occur due to sun exposure, and rot occurs due to bacterial infection. It is desirable to eliminate fruit having any of these defects prior to packaging.

Removal of these defects from the product stream is conventionally done manually by inspectors stationed on both sides of a transport belt. This labor intensive process is expensive and not fully effective. Manual inspection is a tedious process, and it is difficult for an inspector to continuously maintain the degree of concentration necessary to detect the full range of defects identified above, which can sometimes be quite subtle. Although conventional manual sorting is problematic, it is apparent that no fully satisfactory alternative sorting process is available to the industry.

SUMMARY OF THE INVENTION

The present invention is directed to a method and an apparatus for automatically identifying defects in the production of prunes. It has been recognized that various types of defects of interest in the production of prunes are characterized by reflection properties that differ from the reflection properties of acceptable fruit. In particular, bug bites, scabs, cracks, sunburns, rot and other defects are exhibited as roughened or irregular surface areas that are distinguishable by analyzing light or other illumination reflected by such surfaces. The present invention takes advantage of this recognition to provide a reliable, automated system for sorting fruit in the context of prune production.

According to one aspect of the present invention, a method for identifying fruit defects in the production of prunes involves identifying a reflection characteristic indicative of a fruit defect of interest and determining a reflectance threshold based on the reflection characteristic. The reflection characteristic can relate to the intensity, spectral response, polarization and/or other qualities of the reflected illumination, and the threshold can vary depending on the characteristic under investigation and other factors. For example, the reflection characteristic employed can involve reflectivity in a selected wavelength range such as the near infrared (NIR) wavelength range or can involve variation of the illumination's polarization state due to reflection. In such cases, the threshold can be selected based on intensity or relative intensity of reflected illumination having the identified reflection characteristic. Either a positive or a negative threshold analysis can be employed, i.e., defects can be identified based on a detected intensity above or below the threshold depending on the methodology employed. Additionally, the analysis can be direct or indirect. That is, defects can be identified directly (by detecting reflected illumination having characteristics indicative of a defect) or indirectly (by detecting reflected illumination not having characteristics indicative of a defect).

Preferably, the fruit is actively illuminated in an inspection zone, and a sorting device is provided at or downstream from the inspection zone to automatically divert defective fruit from a product stream based on the threshold analysis. The inspection zone can be located, for example, on a fruit transport belt, or inspection can be conducted as the fruit is projected through the air. The sorting device can be any suitable mechanical or contact-free device, such as a puff-jet array, for selectively diverting identified defective fruit. An apparatus for implementing this method preferably includes a source of illumination for illuminating fruit in an inspection zone, a detector for detecting illumination reflected by the fruit, a processor for comparing a value related to the detected illumination to a threshold value, and a sorting device for diverting defects from the product stream in response to the comparison.

In one implementation, defects are identified by analyzing reflected illumination in the near infrared (NIR) frequency range, i.e., illumination having a wavelength between about 635 nm and 1100 nm. Certain defects are difficult to reliably identify by reference to reflected light in the visible spectrum, or under passive or ambient lighting conditions. It has been found that such defects can be more readily identified by illuminating the fruit with illumination having a high intensity of power in the NIR wavelength range and then detecting reflected NIR illumination. In particular, most defects of interest in the production of prunes are characterized under these conditions by a high NIR reflectivity, thereby allowing for a simple and reliable sort. Accordingly, in one embodiment, the apparatus of the present invention includes a source of illumination providing a high intensity of power in the NIR wavelength range and a compatible NIR detector.

In another implementation, defects are identified by analyzing the polarization of reflected illumination. As previously noted, many defects of interest in the production of prunes are exhibited as roughened fruit surfaces. It is believed that, under appropriate conditions, these defects can affect the polarization state of illumination in a manner that facilitates defect identification. Accordingly, in one implementation of the present invention, defects are identified by illuminating the fruit with illumination having a first polarization state, and detecting and analyzing reflected illumination having a second polarization state. Preferably, the fruit is illuminated with plane polarized light. The reflected illumination is detected and analyzed in a manner that indicates reflected illumination that is circularly or elliptically polarized, or which otherwise includes a component outside of the plane of the incident illumination.

The apparatus for implementing this polarization analysis includes a source of illumination having a first polarization state, a detector for detecting reflected illumination having a second polarization state, a processor for comparing a value relative to the detected illumination to a threshold value, and a sorting device for diverting defective fruit from the product stream. Preferably, the source includes a lamp associated with a polarizer for transmitting plane polarized illumination, and the detector includes a camera associated with a polarizer acting as a cross-analyzer to block reflected illumination having the transmitted planar polarization. Due to anisotropic effects, the performance of the apparatus can be enhanced by employing monochromatic illumination. In one embodiment, the lamp provides or is filtered to provide substantially monochromatic illumination in the green wavelength range.

According to another aspect of the present invention, the fruit is subjected to a spectral response altering treatment to enhance a wavelength dependent sorting process. One difficulty associated with sorting fruit in the production of prunes relates to fruit color variation due to varying maturity. Fully mature prunes are characteristically black in color and have a low reflectivity in the NIR wavelength range. Less mature prunes may have a somewhat reddish hue and a higher reflectivity in the NIR wavelength range. Although such less mature prunes are not necessarily considered defective, they are difficult to distinguish from true defective prunes based on a NIR reflection-based sort.

It has been found that such sorts can be enhanced by subjecting the prunes under consideration to a treatment that diminishes the prunes' chlorophyll response. Vegetable matter containing chlorophyll exhibits a marked reflectivity in the NIR wavelength range in addition to the well-known green reflectivity in the visible spectrum. This chlorophyll response is fragile and can be diminished by many types of treatment, including heating, blanching and freezing. By diminishing the prunes' chlorophyll response, even somewhat immature prunes can be readily distinguished from true defects.

The associated method of the present invention includes the steps of subjecting a fruit to a treatment that alters the fruit's reflectivity within a wavelength range, illuminating the fruit with illumination within the same wavelength range, and analyzing illumination within the same wavelength range reflected by the fruit, wherein the reflectivity altering treatment facilitates sorting based on analysis of the reflected illumination. In one implementation, the wavelength range is the NIR wavelength range, and the treatment is a chlorophyll response diminishing treatment. The reflectivity altering method can advantageously be integrated into a process for producing prunes to yield an improved two-step sorting process. The prune production process conventionally includes a heat treatment to dehydrate plums so as to yield prunes. These prunes can be sorted using a reflectivity based analysis as described above. In some cases, the fruit diverted as a result of this initial sort may include immature prunes as well as true defects. This diverted stream is then subjected to a reflectivity altering process and re-sorted in accordance with the present invention to separate acceptable immature prunes from true defects.

The present invention thus improves the process for identifying fruit defects in the production of prunes and allows for automation of the sorting process. The invention increases the effectiveness of defect identification including distinguishing acceptable immature prunes from true defects. Production costs are thus reduced and acceptable yield is increased, thereby benefitting the producer and consumer.

BRIEF DESCRIPTION OF THE DRAWINGS

For a more complete understanding of the present invention and further advantages thereof, reference is now made to the following Detailed Description taken in conjunction with the drawings in which.

DETAILED DESCRIPTION OF THE INVENTION

The present invention involves automatic identification of defects in the production of prunes based on characteristics of reflected illumination. In the following description, the invention is set forth with respect to specific exemplary embodiments and parameters for implementing sorts based on NIR reflectivity and based on polarization phenomena. However, it will be appreciated that various modifications and additions are possible in accordance with the teachings of the present invention.

Figure 1:
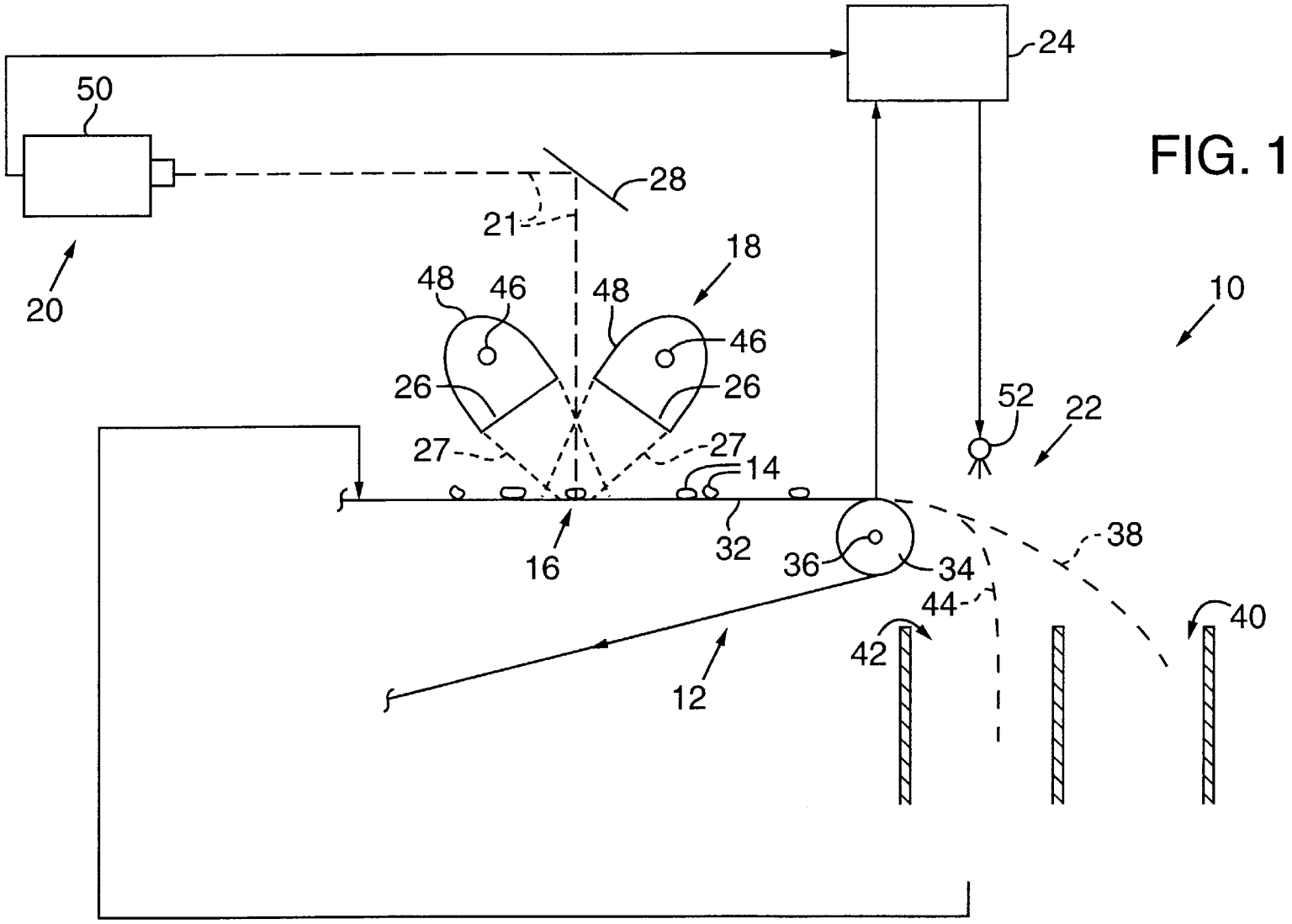
FIG. 1 is a schematic diagram showing a side elevation view of a prune sorting apparatus constructed in accordance with the present invention.
Figure 2:
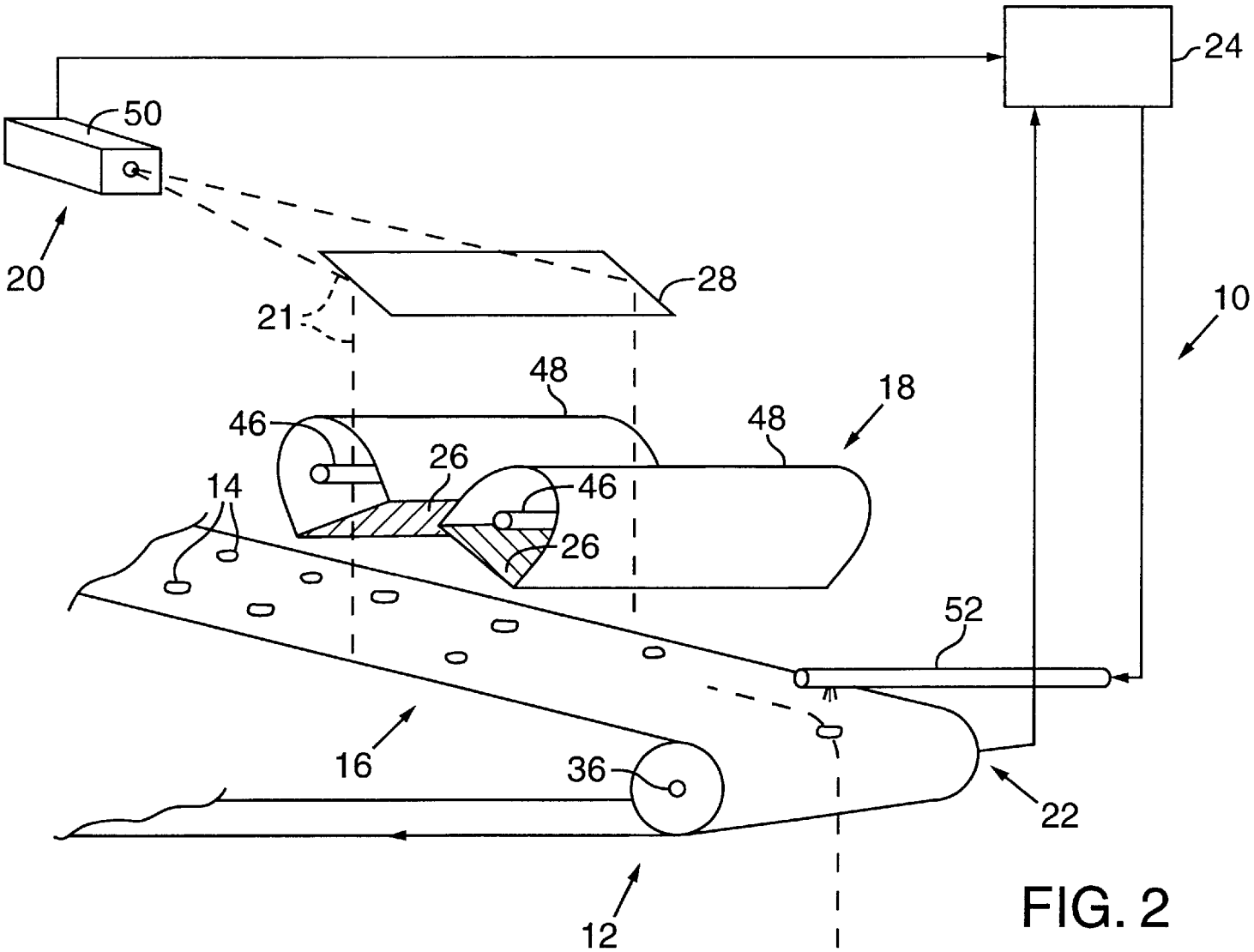
FIG. 2 is a perspective view showing the prune sorting apparatus of FIG. 1.
Figure 3:
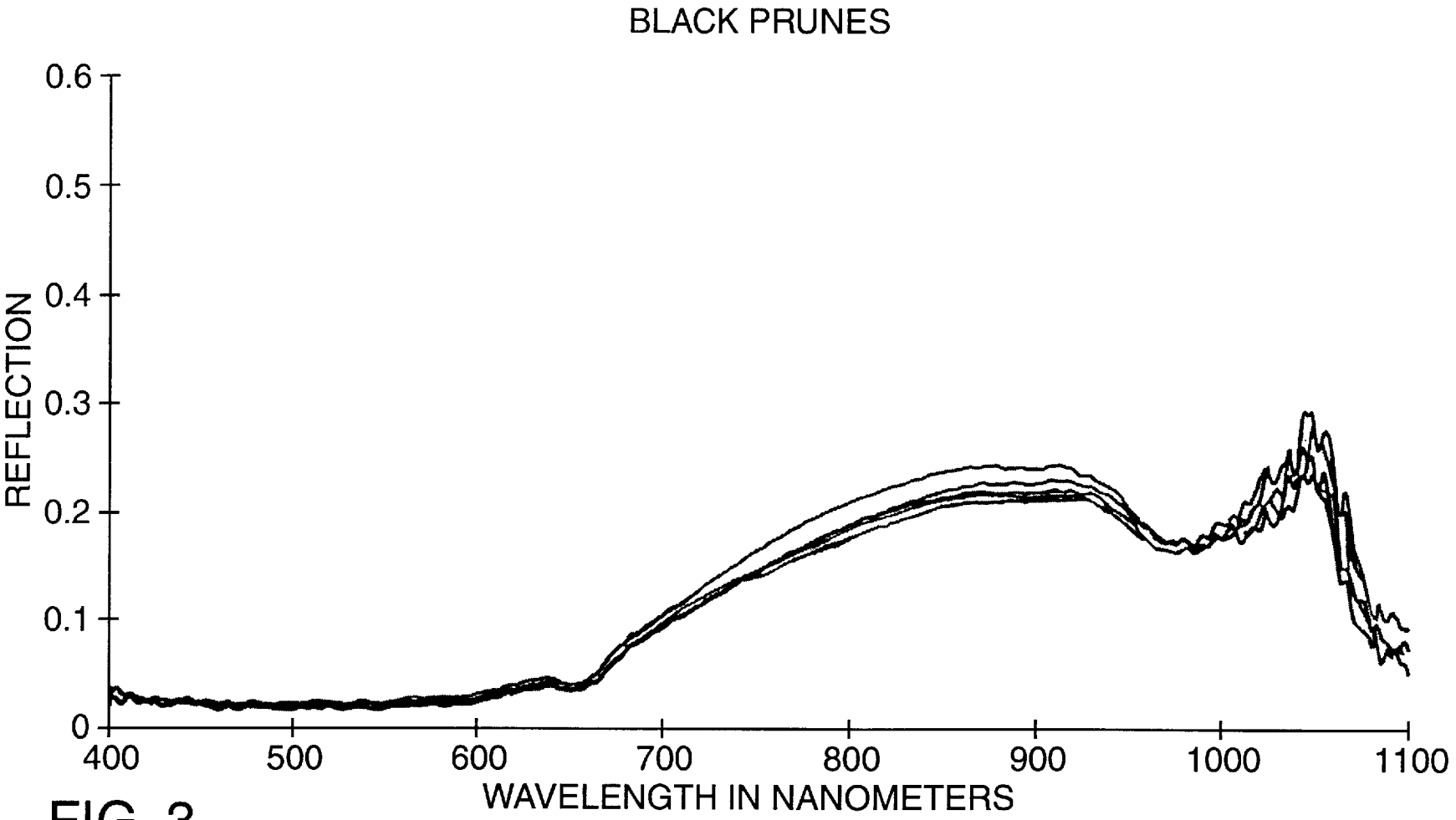
FIG. 3 is a graph showing the spectrographic reflectance characteristics for a number of black prunes.
Figure 4:
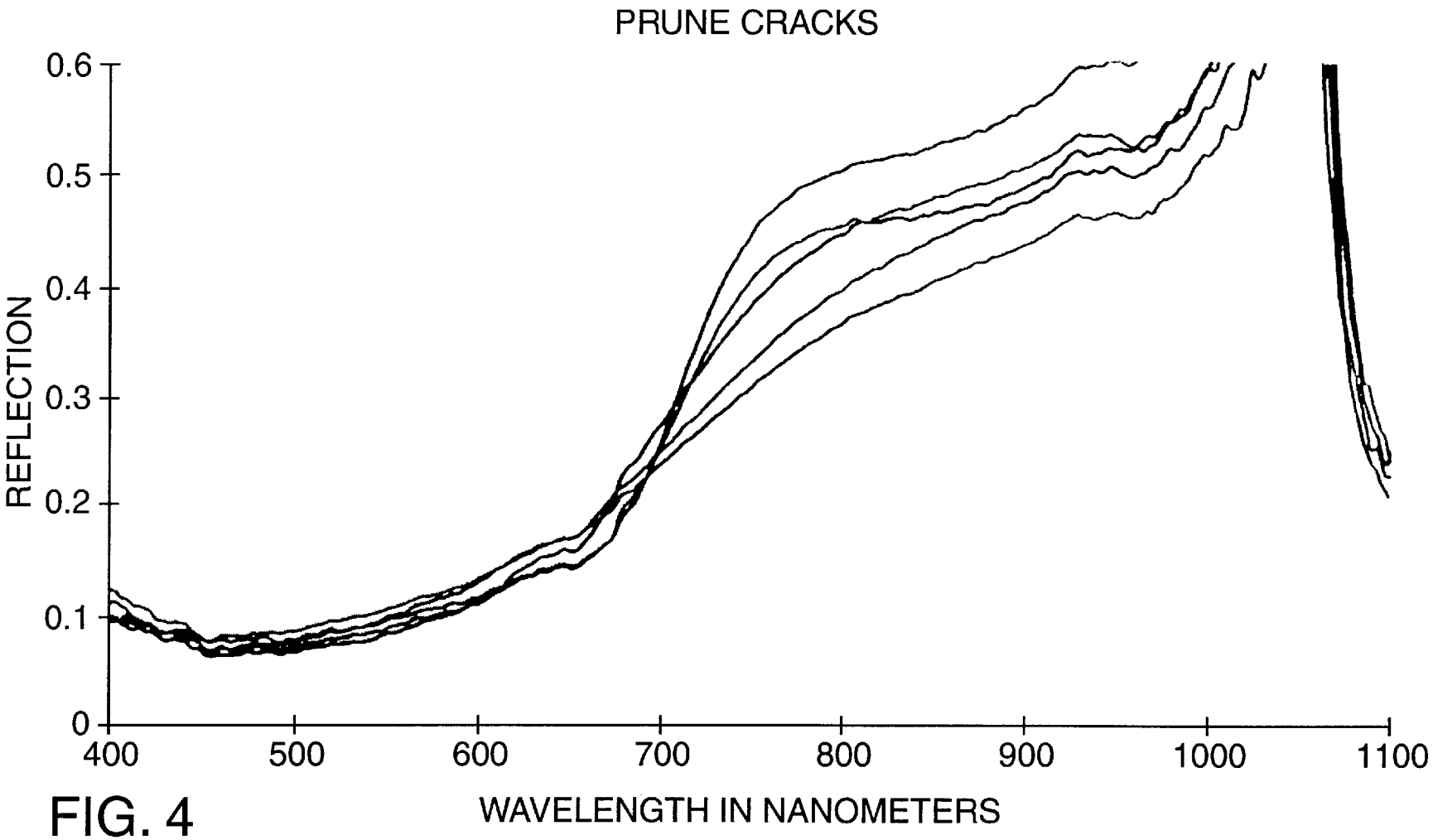
FIG. 4 is a graph showing the spectrographic reflectance characteristics for a number of defective, cracked prunes.
Figure 5:
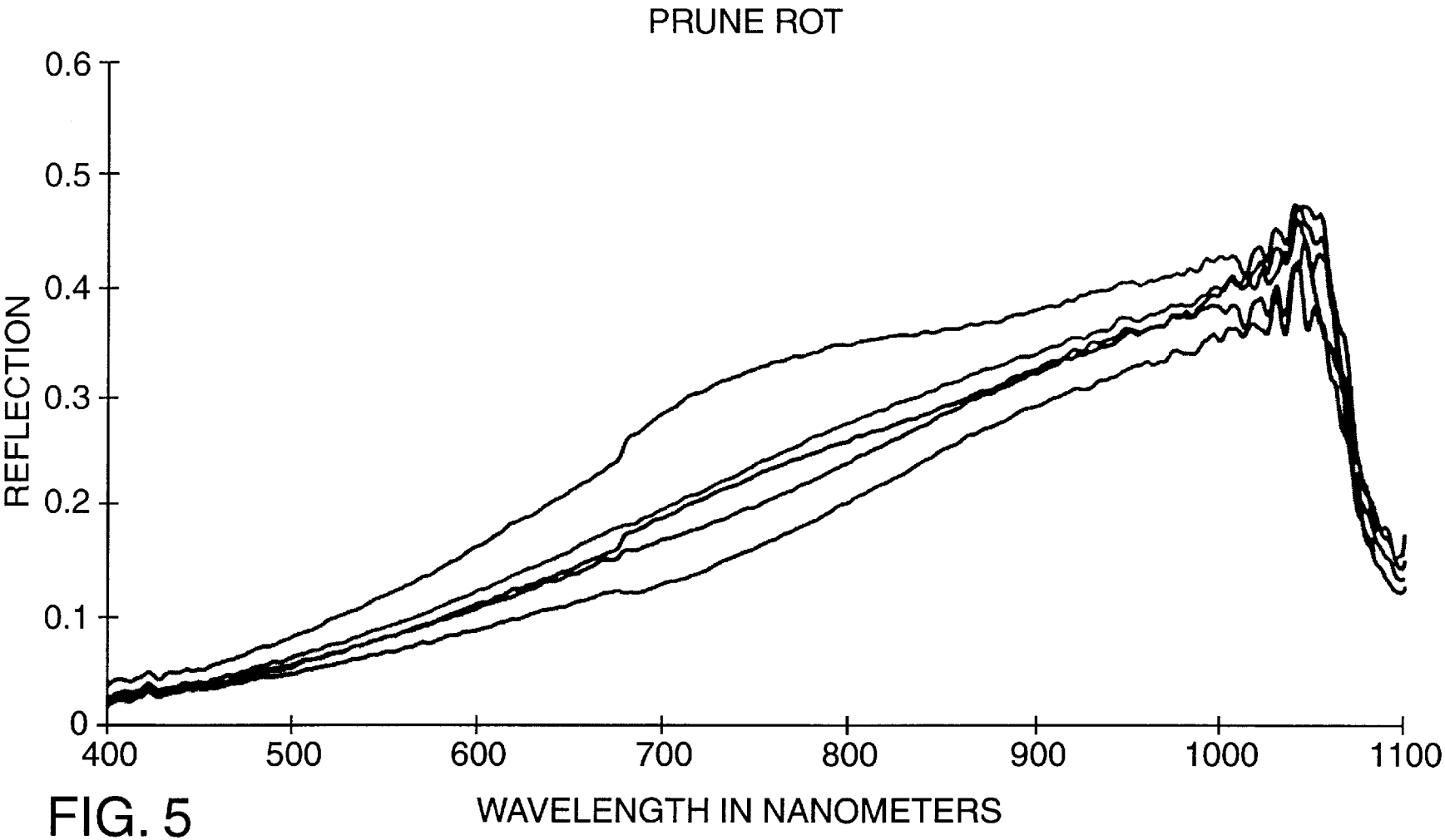
FIG. 5 is a graph showing the spectrographic reflectance characteristics for a number of defective, rotted prunes.
Figure 6:
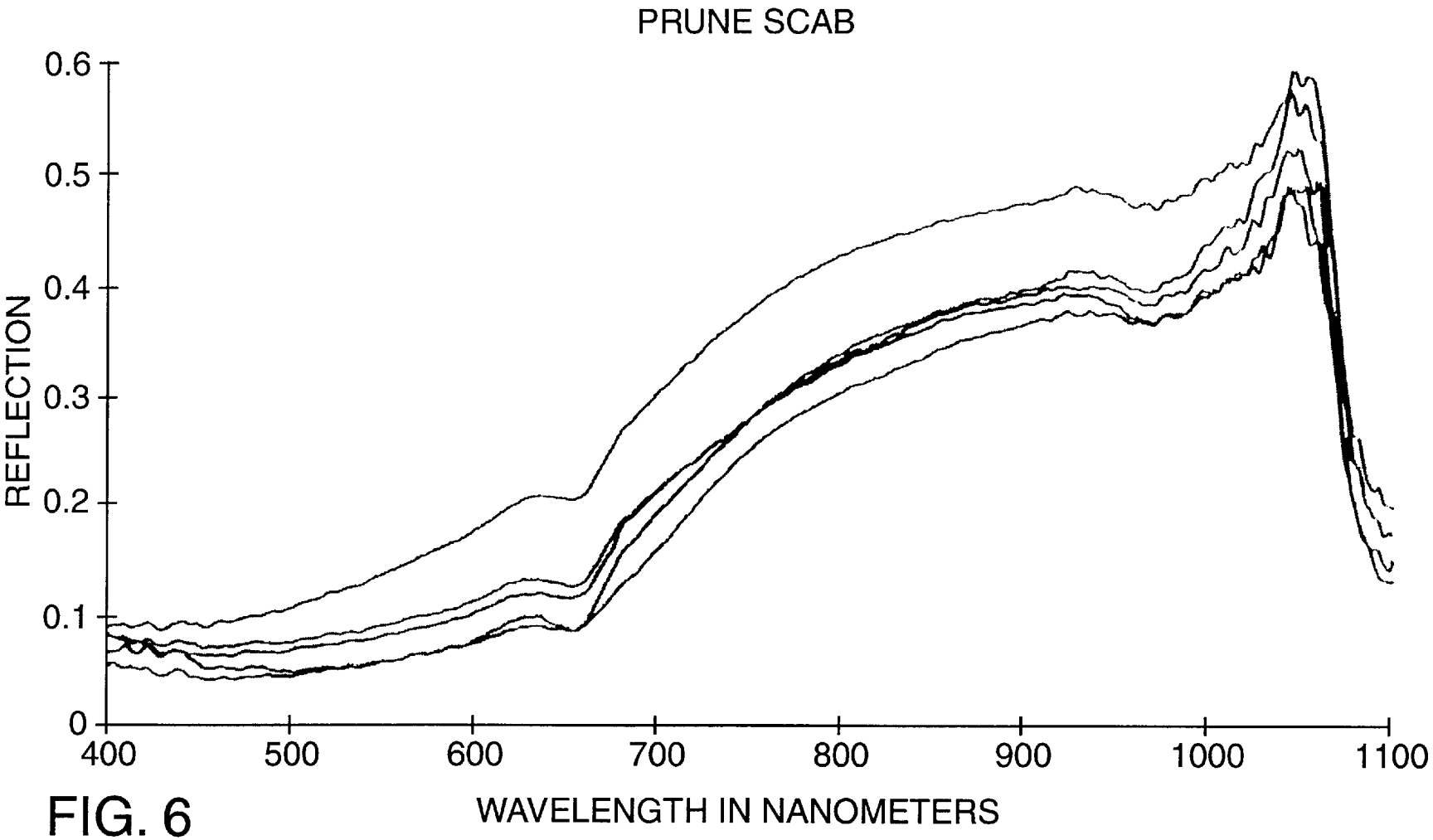
FIG. 6 is a graph showing the spectrographic reflectance characteristics for a number of defective, scabbed prunes.

A prune sorting apparatus 10 constructed in accordance with the present invention is shown in FIGS. 1–2. Generally, the apparatus 10 includes: a transport system 12 for transporting fruit 14 through an inspection zone 16; an illumination system 18 for illuminating fruit 14 in the inspection zone 16; a detector system 20 for detecting reflected illumination 21; a sorting system 22 for separating defective fruit from good fruit; and a control system 24 for controlling operation of the sorting system 22 based on signals from the detector system 20 and transport system 12. The illustrated apparatus 10 incorporates a number of optical components including polarizers 26 for polarizing the transmitted illumination 27, a mirror 28 for reflecting illumination 21 from the inspection zone 16 to the detector system 20 for selectively transmitting illumination 21 to the detector system 20. Although the fruit 14 is inspected on the transport system 12 in the illustrated embodiment, it will be appreciated that in-the-air inspection or other techniques may be employed if desired.

The transport system 12 includes an endless conveyor belt 32 driven by a drive roller (not shown) about a roller 34 mounted on a shaft 36. The belt 32 is driven at a speed selected so that the fruit 14 is projected from the belt 32 along a trajectory 38 into an accept bin 40, unless deflected (as will be described below) by the sorting system 22 into reject bin 42 along a trajectory 44. Preferably, the belt 32 is provided with a black matte or other anti-reflective finish to reduce reflectance and improve the effective signal-to-noise ratio as detected by detector system 20. As shown, the fruit 14 may be distributed in an essentially random fashion across the length and width of the belt 32.

The illumination system 18 of FIGS. 1–2 provides a stripe of illumination in the inspection zone 16 having a substantially uniform intensity across the width of the belt 32. The illustrated system 18 includes a pair of elongate lamps 46 positioned on opposite sides of the inspection zone 16 to reduce errors due to shadowing. The type of lamp employed will depend on the specific reflection characteristic under analysis as will be described below. Each lamp 46 is housed within an elliptical mirrored reflector 48 oriented to focus illumination from the lamp 46 on the inspection zone 16. An enclosure (not shown) may be provided at the base of the reflector 48 to protect the lamp from debris or contaminants that could degrade performance or diminish lamp life and to prevent broken bulbs from falling into the product stream. The illustrated illumination system 18 also includes a linear polarizer 26 associated with each lamp 46 to transmit plane polarized illumination. The illustrated polarizer 26 comprises a conventional polymeric polarizing sheet that includes embedded long-chain particles aligned to define a polarization axis. As shown, the polarizer 26 extends across the base of reflector 48. It will thus be appreciated that the illumination 27 incident upon fruit 14 in the inspection zone 16 will be plane polarized.

In the embodiment of FIGS. 1–2, the detector system 20 includes a camera 50. The camera 50 detects any incident reflected illumination 21 and provides an output signal indicative of the intensity of the illumination 21 and the associated location of the fruit 14 on belt 32. The illustrated camera 50, which may be a black and white or IR camera manufactured by SRC Vision, Inc,. is a digital camera having a high resolution detector plane, where the radiation sensitive pixels of the detector plane are optically mapped to corresponding locations of the inspection zone 16. The detector plane is read out on a periodic basis by appropriate data storage registers or the like. The output signal from camera 50 therefore includes substantially real-time intensity information on a pixel-by-pixel basis.

Figure 11:
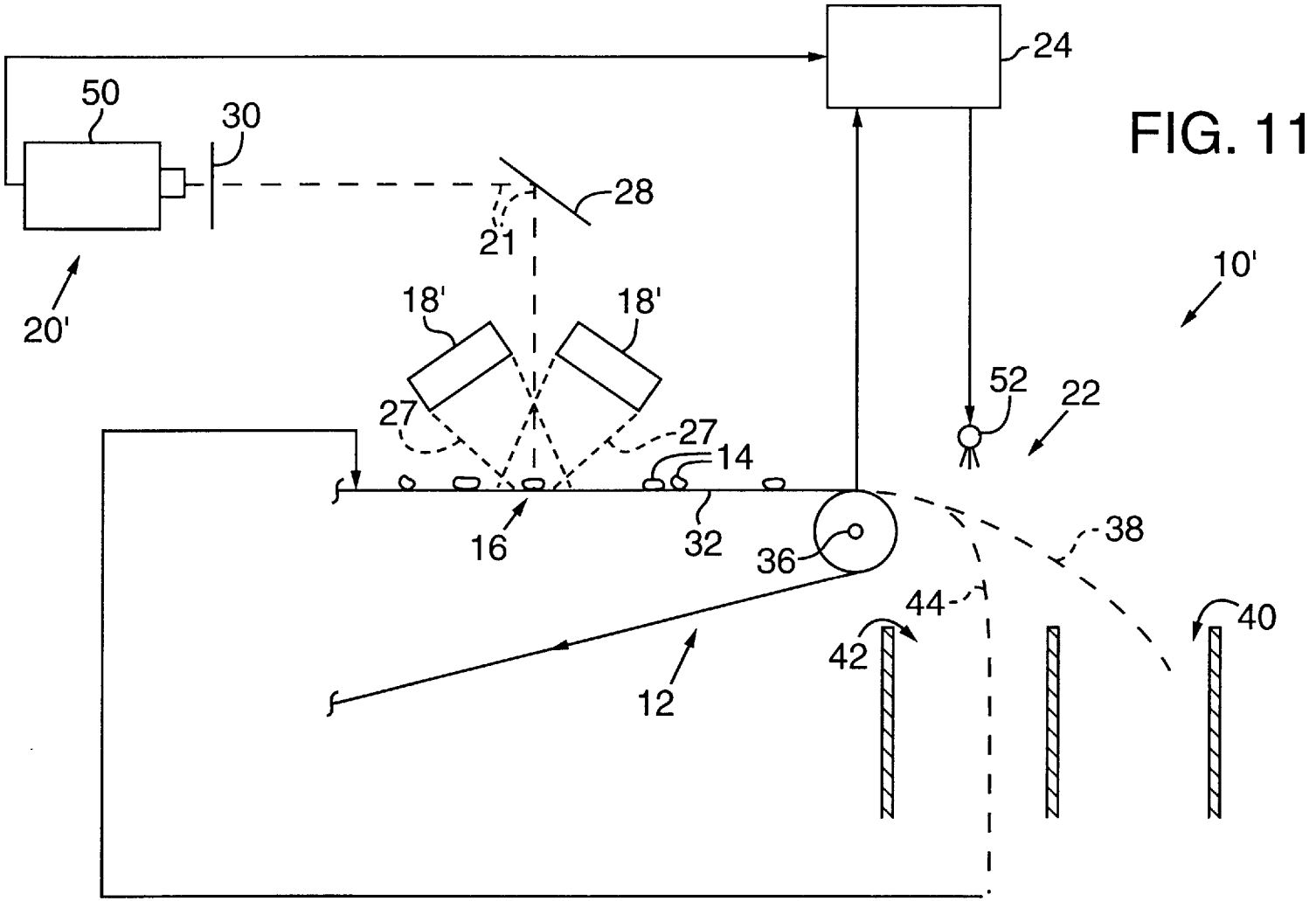
FIG. 11 is a schematic diagram showing a side elevation view of an alternative prune sorting apparatus constructed in accordance with the present invention.
Figure 12:
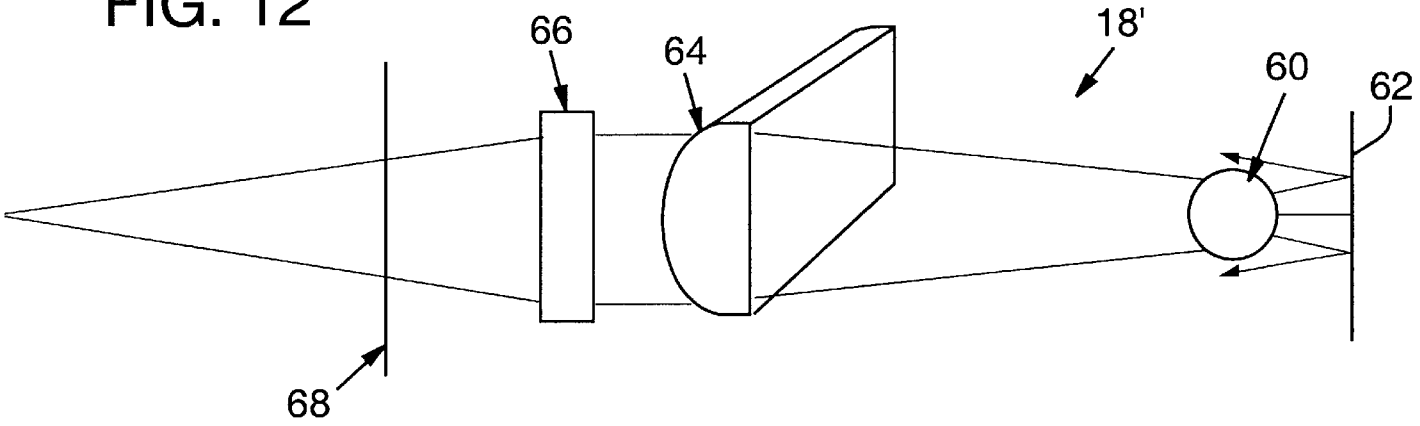
FIG. 12 is a side elevation view of the illumination system of the apparatus of FIG. 11.
Figure 13:
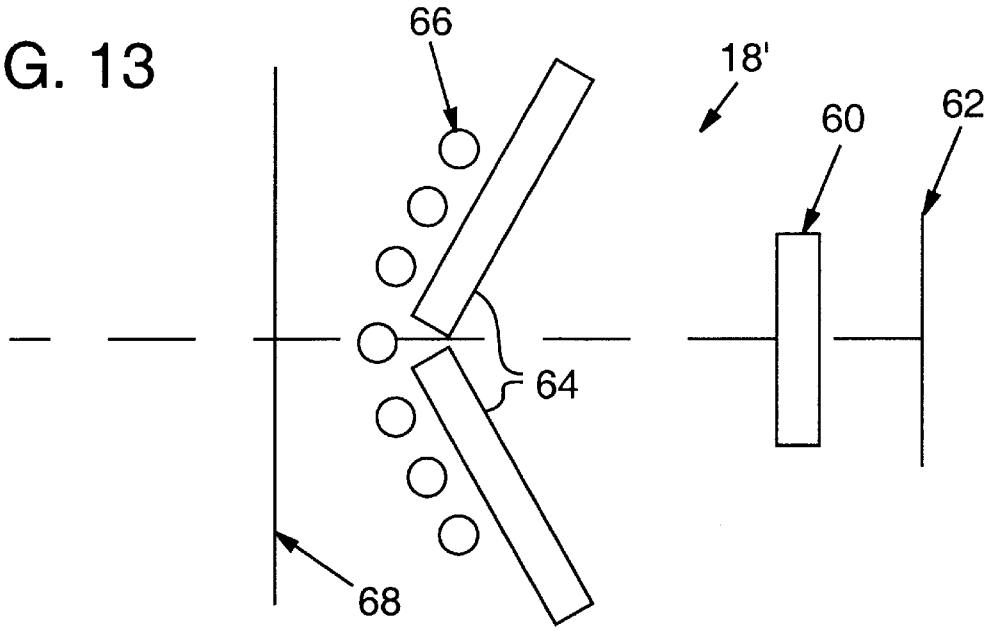
FIG. 13 is a plan view showing the illumination system of FIG. 12.

FIGS. 11–13 illustrate an alternative embodiment of the sorting apparatus 10' for detecting defective fruit based on polarization phenomena. As shown in FIG. 11, the illumination system 18' and detector system 20' of apparatus 10' differ from those of the apparatus shown in FIGS. 1–2. The illumination system 18' is provided as two units positioned approximately 18 inches from the belt 32. Details of the detector system 18' are shown in FIGS. 12–13. Each unit includes a thallium arc lamp 60 for emitting substantially monochromatic illumination having a wavelength in the green range; a white diffuse reflector 62 disposed behind the lamp 60; a pair of substantially hemi-cylindrical lenses 64 for focusing illumination as a bright stripe on the belt 32 in the inspection zone 16; a series of optical glass cylinders 66 for providing a more uniform distribution of illumination across the width of the belt 32 and a polarizer sheet 68, such as described above, for transmitting substantially plane polarized illumination from the lamp 60 to the inspection zone 16.

The detector system 20' as shown in FIG. 11 includes analyzer 30 and a camera 50. The analyzer 30 can be constructed from a conventional polymeric polarizing sheet similar to polarizers 26. However, the analyzer 30 is oriented so that its polarization axis is substantially perpendicular to the polarization plane of the incident plane polarized radiation. That is, the polarizer sheets 68 and analyzer 30 are arranged relative to the propagation path of the illumination 21, 27 as cross-polarized sheets so that reflected illumination 21 retaining the transmitted plane polarization is substantially blocked from camera 50 disregarding, for the moment, anisotropic effects. As will be understood from the description below, the polarizer sheets 68 and analyzer 30 allow for detection based on polarization phenomena associated with fruit defects.

The output signal from the detector system 20 or 20' is transmitted to control system 24 which contains a microprocessor. The control system 24 also receives information regarding the belt speed of transport system 12. Such rate information may be provided in any suitable form. For example, in the case of constant speed operation, a speed constant can be pre-programmed into control system 24. Alternatively, rate information can be obtained via an interface with a control panel or motor of the transport system 12. Where a more positive feedback based indication is desired, a rate signal may be obtained from an encoder, for example, mounted on a roller shaft 36.

The control system 24 of the illustrated embodiment performs a number of functions. The control system 24 first implements a threshold analysis to identify any fruit defects. Although other arrangements are possible, the illustrated apparatus 10 is configured to conduct a positive threshold analysis, i.e., to identify defects based on received illumination intensity in excess of a determined threshold. The threshold is determined based on the reflection characteristic (e.g., polarization state) under consideration, the performance of the illumination system 18 or 18' and optical components, and certain theoretically and/or empirically derived criteria for accurately distinguishing between good fruit and defective fruit.

When the threshold analysis identifies a defect, the control system 24 controls operation of the sorting system 22 so as to deflect the defective fruit into the reject bin 42. In this regard, the control system 24 determines where the defective fruit is located relative to the width of the belt 32 and synchronizes operation of the sorting system 22 to movement of the fruit 14 so that the sorting system 22 is activated at the appropriate time. Preferably, the sorting system 22 can be selectively activated at discrete locations spaced across the width of the belt 32 so that defects can be rejected substantially without affecting adjacent acceptable fruit. Any suitable mechanical, pneumatic or other deflecting mechanism can be used in this regard. The illustrated sorting system 22 includes a linear array of puff-jets distributed along the length of a control bar 52. Upon activation, each puff-jet provides an instantaneous and highly localized gas discharge sufficient to deflect defective fruit into reject bin 42 as indicated by trajectory 44. The control system 24 uses information regarding the location of the defect relative to the width of the belt 32 to determine which puff-jet should be activated. The timing for activating the sorting system 22 is determined mathematically based on knowledge of the relative positions of the inspection zone 16 and the control bar 52, and the operation of the transport system 12. The control system 24 uses such timing information to implement an appropriate delay before transmitting an activation signal to the sorting system 22.

The following discussion sets forth the basis for a positive threshold analysis with respect to NIR and polarization reflection characteristics of prune defects. It will be appreciated that other reflection characteristics and identification criteria can be utilized in accordance with the present invention.

Referring to FIGS. 3–6, the spectrographic reflection characteristics for good black prunes, defective cracked prunes, defective rotted prunes and defective scabbed prunes, respectively, are graphically shown. As can be seen, both good fruit and defective fruit exhibit a low reflectivity in the visible spectrum. By contrast, all of the types of defects illustrated exhibit a markedly higher reflectivity in the NIR spectrum, making for a relatively easy sort. In particular, it will be observed that the good black prunes have a maximum reflectivity of less than about 30% throughout the NIR range, and a maximum reflectivity of no more than about 20% in the 750–1000 nm wavelength range. The fruit defects have a reflectivity greater than 30% in the 750–1000 nm range, and even higher reflectivity when the entire NIR range is considered. This demonstrates that an accurate threshold sort can be conducted based on NIR reflectivity and, especially, based on reflectivity in the 750–1000 nm range. In the latter range, a threshold value may be selected based on a reflectivity in the 20–30% range. It will be appreciated that the specific value employed may vary from harvest to harvest or based on other factors.

Figure 7:
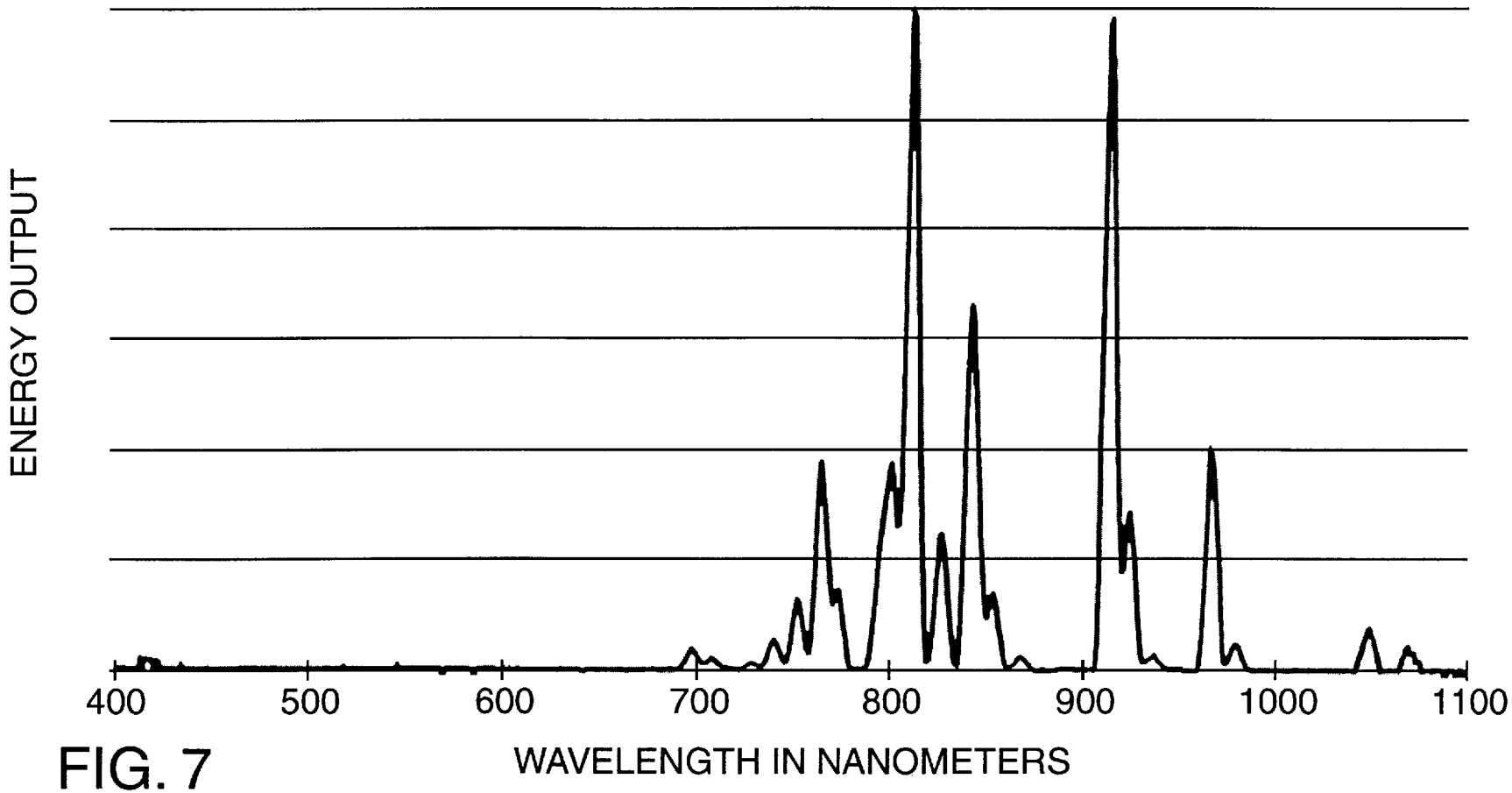
FIG. 7 is a graph showing the spectrographic output characteristics for a NIR lamp that can be used in the prune sorting apparatus of FIG. 1.

FIG. 7 shows the spectrographic output characteristics of a rare gas Argon lamp that is used in the illumination system according to a NIR reflection based implementation of the present invention. As shown, the power output of the rare gas Argon lamp is highly concentrated in the 750–1000 nm wavelength range corresponding to wavelength range noted above where good fruit is readily distinguished from defective fruit. The NIR implementation of the illustrated embodiment thus involves illuminating fruit 14 in the inspection zone 16 using a lamp 46 that has a high intensity of power in the NIR, detecting illumination in the NIR range using an appropriate detector, and operating the sorting system 22 to reject fruit when the detected illumination exceeds an appropriately selected threshold.

It will be appreciated that such a sort can be conducted without the illustrated polarizers 26. However, it has been found that the irregular surface of a prune results in glints of illumination that interfere with the threshold analysis. The effect of these glints can be reduced by employing the polarizers 26 as shown. The polarizers 26 also tend to block extraneous illumination (e.g., reflected by the belt 32) thereby improving the effective signal-to-noise ratio as detected by the detector system 20.

Figure 8:
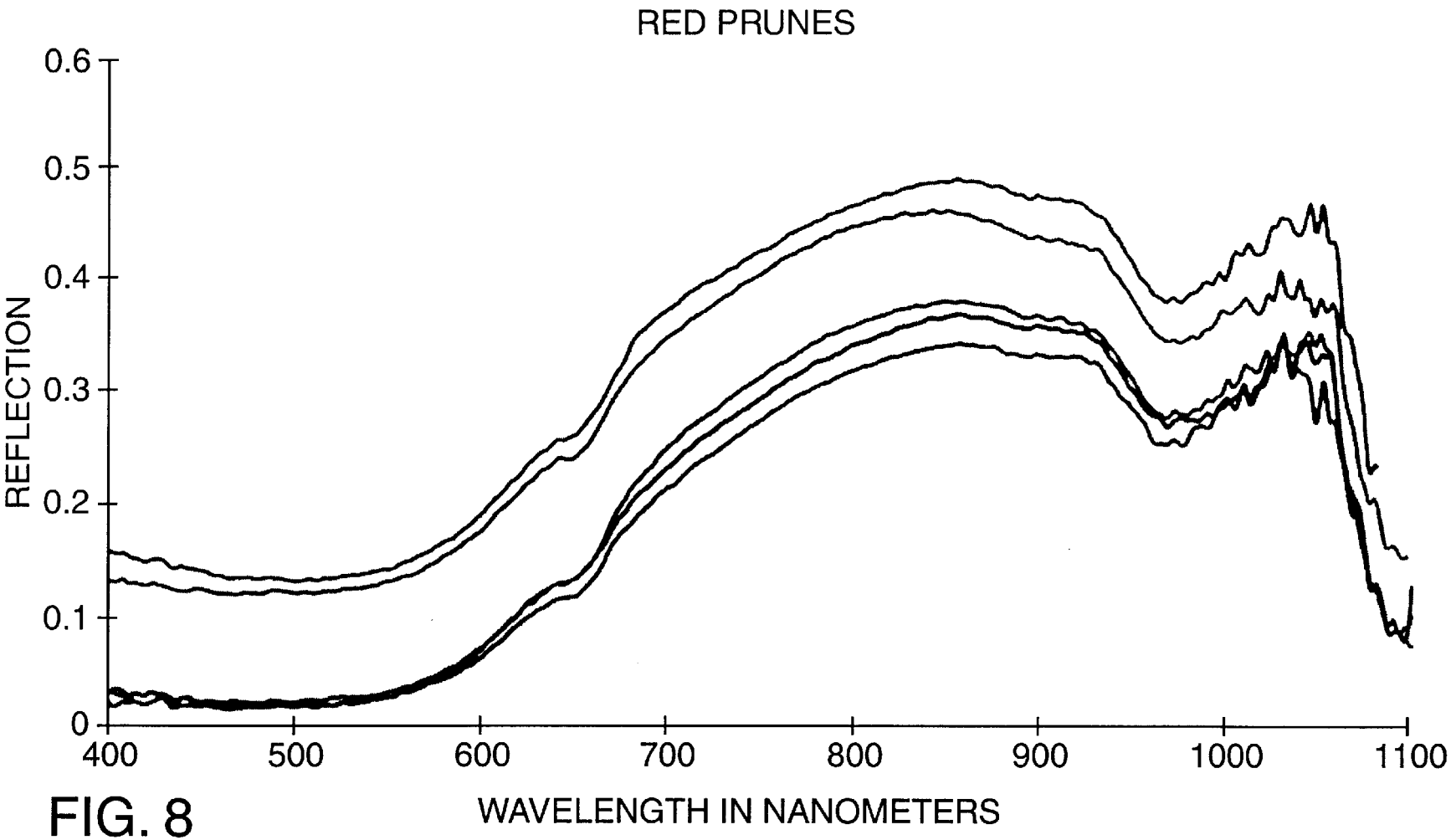
FIG. 8 is a graph showing the spectrographic reflectance characteristics for a number of red prunes that are not necessarily considered to be defects.

One difficulty associated with the NIR sorting process as described above relates to less mature or so-called red prunes. These prunes are not considered defective but may have NIR reflection characteristics, as shown in FIG. 8, that are difficult to distinguish from those of defective fruit. As a result, when a particular harvest yields a large number of red prunes, the NIR sort alone could reject an unacceptable quantity of good fruit.

Figure 9:
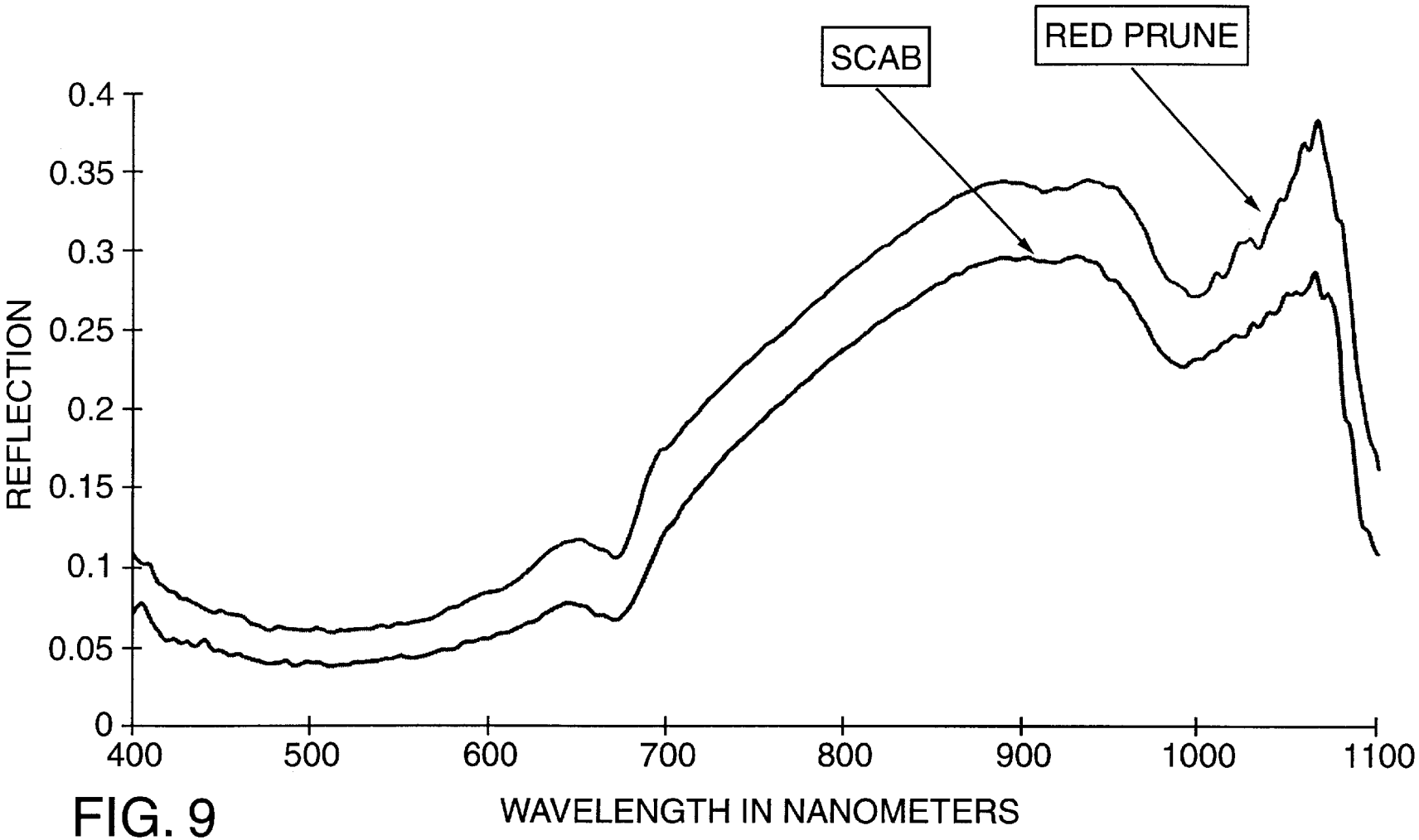
FIG. 9 is a graph showing the spectrographic reflectance characteristics for a scabbed prune and a red prune prior to blanching.
Figure 10:
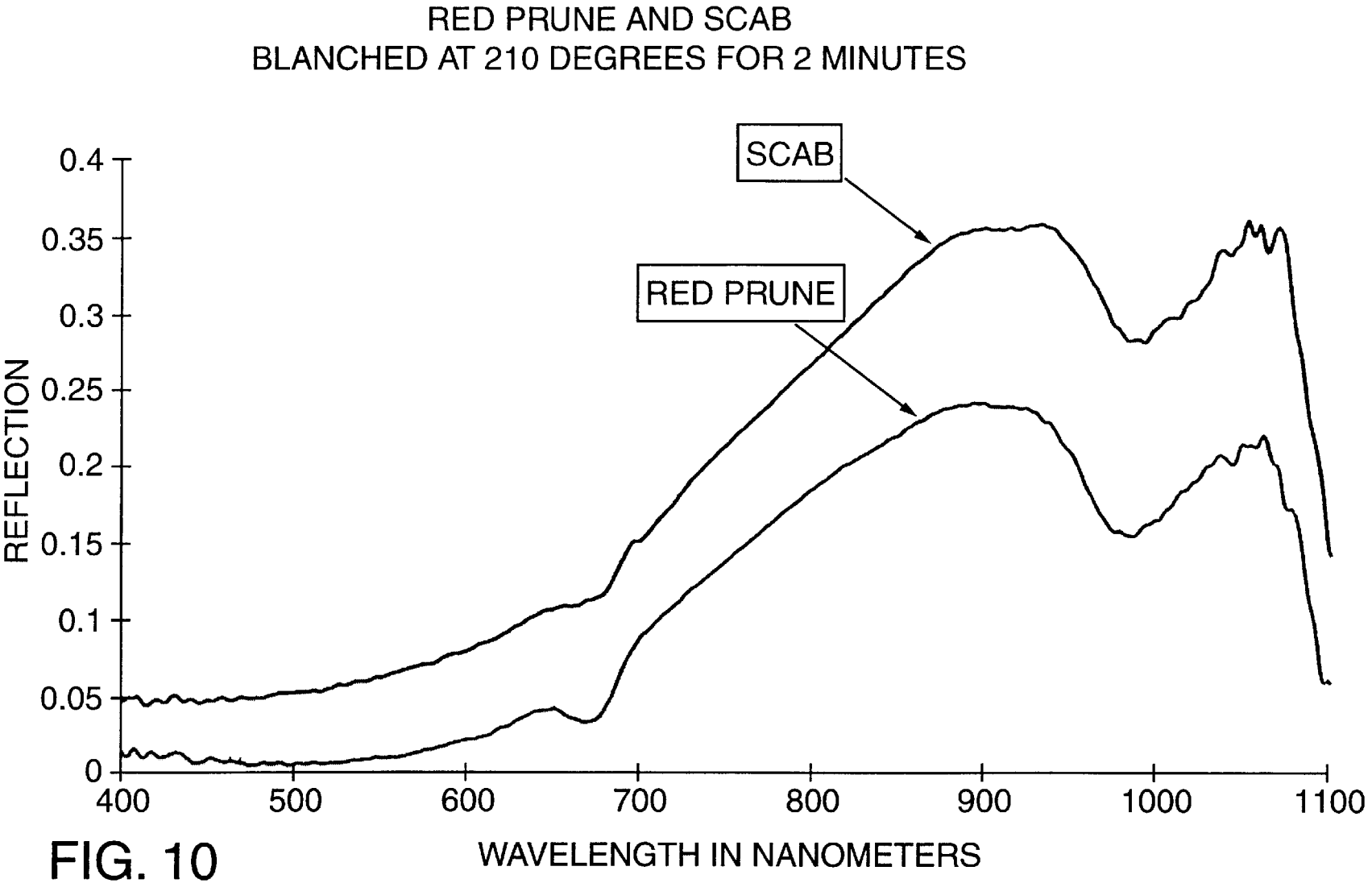
FIG. 10 is a graph showing the spectrographic reflectance characteristics for a scabbed prune and a red prune after blanching.

This problem is addressed in accordance with the present invention by subjecting suspect fruit to a treatment to diminish the fruit's chlorophyll response. FIGS. 9–10 show a comparison of the spectrographic reflectance characteristics of a good red prune and a defective scabbed fruit both before (FIG. 9) and after (FIG. 10) such a treatment. The treatment employed in this case involved blanching the fruit at 210° F. for two minutes. As shown in FIG. 9, the good red fruit initially had a higher reflectivity than the defective scabbed fruit in the NIR range. After the treatment, the reflectivity of the good red fruit is reduced and the reflectivity of the defective scabbed fruit is increased as shown in FIG. 10, thereby allowing for a positive threshold sort as described above.

This chlorophyll response treatment can be implemented in the context of the present invention as follows. Initially, all fruit is sorted using the NIR threshold analysis as described above. When there is a concern regarding possible rejection of good red prunes, the contents of the reject bin 42 are subjected to blanching or other treatment for affecting the fruit's chlorophyll response. In practice, a conveyor belt can be provided at the base of the reject bin to continuously deliver rejected fruit to a chlorophyll response treatment station. The treated fruit is then returned to the transport system for a second pass through the inspection zone 16. In this manner, fruit yield is improved without unnecessarily treating good black prunes which are accepted on the first pass.

As an alternative to the NIR reflectivity based analysis as described above, the fruit 14 can be sorted based on analysis of the polarization state of the reflected illumination. It has been noted that the roughened fruit surfaces associated with various defects tend to alter the polarization state of incident illumination, whereas acceptable fruit is less likely to produce such an effect. As described above, the polarizers 26 transmit substantially plane polarized illumination. When such illumination is reflected by good fruit, the reflected radiation which is unaltered by the good fruit is largely blocked by analyzer 30, such that the detector system 20 detects little intensity. However, a portion of the plane polarized illumination reflected by defective fruit will be altered and will not be plane polarized, and will therefore pass through the analyzer 30 with some intensity. This effect can be utilized to conduct a positive threshold sort as described above.

Ideally, this polarization analysis could be implemented with virtually any type of lamp 46. In practice, though, it has been found beneficial to employ monochromatic illumination due to anisotropic performance characteristics of the apparatus 10. Excellent results have been obtained by employing a thallium lamp to provide substantially monochromatic illumination having a green wavelength. Under these conditions, the fruit substantially disappears except for defects from the camera's perspective, thus allowing for an easy and accurate sort.

While various embodiments or implementations of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A method for use in detecting fruit defects, comprising the steps of:

subjecting a fruit to a treatment to affect a chlorophyll response of said fruit to illumination in a selected spectral range;

detecting illumination in said selected spectral range reflected by said treated fruit; and analyzing said reflected illumination to detect fruit defects.

2. The method of claim 1 in which said selected spectral range comprises the near infrared spectral range and said method further comprises the step of illuminating said fruit with illumination having a high intensity in the near infrared spectral range.

3. The method of claim 1 in which said selected spectral range comprises the near infrared spectral range.

4. The method of claim 1 in which said step of detecting illumination includes detecting a polarization characteristic of said reflected illumination.

5. The method of claim 1 in which said step of detecting illumination comprises employing a digital camera to provide substantially real time information based on said reflected illumination.

6. The method of claim 1 in which said step of analyzing comprises:

determining a reflectance threshold relative to an illumination reflection characteristic indicative of said fruit defects; and conducting a positive threshold analysis wherein said fruit defects are identified based on a reflected illumination intensity in excess of said reflectance threshold.

7. The method of claim 1 further comprising the step of actively illuminating said fruit.

8. The method of claim 7 in which said step of actively illuminating comprises illuminating said fruit with transmitted illumination having a high intensity in the near infrared range.

9. The method of claim 7 in which:

said step of illuminating comprises transmitting illumination having an incident first polarization state; and said step of detecting illumination comprises detecting reflected illumination having a second polarization state that is different from said incident first polarization state.

10. The method of claim 1, further comprising the step of activating a sorting device to selectively remove said fruit from a product stream based on said step of analyzing.

11. The method of claim 1, further comprising the step of processing said fruit to produce prunes.

12. A method for use in identifying fruit defects in a fruit product stream, comprising the steps of:

identifying an illumination reflection characteristic indicative of a fruit defect of interest;

determining a reflectance threshold relative to said illumination reflection characteristic;

detecting illumination reflected by a fruit in said fruit product stream;

analyzing said reflected illumination relative to said reflectance threshold to identify fruit defects;

selectively removing said fruit from said fruit product stream based on said step of analyzing and thereby producing a first acceptable fruit product stream and a removed fruit;

treating said removed fruit to diminish a chlorophyll response of said removed fruit;

detecting illumination reflected by said removed fruit after said step of treating said removed fruit;

analyzing said illumination reflected by said removed fruit to detect fruit defects; and segregating said removed fruit based on said step of analyzing illumination reflected by said removed fruit and thereby producing a second acceptable fruit product stream.

13. The method of claim 12 in which the step of detecting illumination reflected by said removed fruit includes detecting illumination in the near infrared spectral range reflected by said removed fruit.

14. The method of claim 10, further comprising the step of processing said first and second acceptable fruit product streams to produce prunes.

15. An apparatus for use in detecting fruit defects, comprising:

a fruit treatment area;

a heat source for treating a fruit positioned in said fruit treatment area to affect a chlorophyll response of said fruit to illumination in a selected spectral range and thereby produce a treated fruit;

a fruit inspection area;

an illumination source for illuminating said treated fruit positioned in said fruit inspection area; and a detector for detecting a portion of said illumination reflected by said treated fruit in said selected spectral range.

16. The apparatus of claim 15 in which:

said illumination source provides illumination having a high intensity in the near infrared spectral range; and said selected spectral range comprises the near infrared spectral range.

17. The apparatus of claim 15, further comprising:

a first light polarizer, optically interposed between said illumination source and said fruit inspection area, for passing illumination having a first polarization state; and a second light polarizer, optically interposed between said fruit inspection area and said detector, for passing illumination having a second polarization state that is different from said first polarization state.

18. The apparatus of claim 17 in which said first and second polarizers are of a linear polarizer type and are oriented so that said first polarizer passes substantially plane polarized illumination and said second polarizer substantially blocks said plane polarized illumination.

19. The apparatus of claim 15 in which said illumination source comprises a substantially monochromatic source characterized by a high intensity output at a selected wavelength.

20. The apparatus of claim 19 in which said selected wavelength is within the green wavelength range.

* * * * *

UNITED STATES PATENT AND TRADEMARK OFFICE

CERTIFICATE OF CORRECTION

PATENT NO. : 5,808,305
DATED : October 23, 1996
INVENTOR(S) : Leidecker et al.

It is certified that error appears in the above-identified patent and that said Letters Patent is hereby corrected as shown below:

On the title page, item[57]

Abstract, line 15, change "inorder" to read --in order --.

Column 10, line 5, claim 14, change "claim 10" to read --claim 12--.

Signed and Sealed this

Second Day of May, 2000

*Attest:*

Q. TODD DICKINSON

*Attesting Officer*

*Director of Patents and Trademarks*